US005938177A

United States Patent [19]

Fonda

[11] Patent Number: 5,938,177

[45] Date of Patent: Aug. 17, 1999

[54] POWER BAR DEVICE

[76] Inventor: Scott J. Fonda, 4091 E. Lake Rd., Canandaigua, N.Y. 14424

[21] Appl. No.: 09/075,537

[22] Filed: May 11, 1998

[51] Int. Cl.[6] ..... B66F 15/00

[52] U.S. Cl. ..... 254/25; 254/26 E; 254/129

[58] Field of Search ..... 254/25, 26 E, 254/129, 130, 131

[56] References Cited

U.S. PATENT DOCUMENTS

| | | | |
|---|---|---|---|
| 527,514 | 10/1894 | Steed | 254/130 |
| 1,486,820 | 3/1924 | Wilder | 254/25 |
| 1,692,722 | 11/1928 | Dayton et al. | 254/25 |
| 2,676,784 | 4/1954 | Howard | 254/130 |
| 3,612,485 | 10/1971 | McAfee | 254/130 |

*Primary Examiner*—Robert C. Watson

[57] ABSTRACT

A power bar device including first bar. The first bar has a first end, a bend, a body portion and wedged shaped working end projecting from the bend. The body portion has a pair of generally rectangular plates fixedly attached. Each of the pair of plates having a plurality of openings. A second bar has a plurality of openings therethrough and an arced foot member that is fixedly attached to one end and spaced from the plurality of opening. The second bar is positioned between a gap of the pair of plates. A pin is positioned simultaneously through atleast one of the openings of the second bar and atleast one of the opens of each of the pair of plates, when each are in alignment therewith, for securing the second bar between the plates of the first bar.

1 Claim, 2 Drawing Sheets

POWER BAR DEVICE

BACKGROUND OF THE INVENTION

1. Field of the Invention

The present invention relates to a power bar device and more particularly pertains to providing a specialized bar that allows the user to adjust the leverage area for use of the wedged shaped working end.

2. Description of the Prior Art

The use of a crowbar is known in the prior art. More specifically, crowbars heretofore devised and utilized for the purpose of removing one item mounted to another item are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,789,134 to Tenuto, Hodge, Willimas and Karreman discloses a forcible entry tool. U.S. Pat. No. 4,042,210 to Feldmann discloses an adjustable leverage pry bar. U.S. Pat. No. 4,844,416 to Hand discloses a crow bar. U.S. Pat. No. 5,044,033 to Fosberg discloses a forcible entry tool. U.S. Pat. No. 5,322,264 to Giambro discloses a utility bar tool. Lastly, U.S. Patent Des. 352,220 to Schreoder discloses a pry bar.

In this respect, the power bar device according to the present invention substantially departs from the conventional concepts and designs of the prior art, and in so doing provides an apparatus primarily developed for the purpose of providing a specialized bar that allows the user to adjust the leverage area for use of the wedged shaped working end.

Therefore, it can be appreciated that there exists a continuing need for a new and improved power bar device which can be used for providing a specialized bar that allows the user to adjust the leverage area for use of the wedged shaped working end. In this regard, the present invention substantially fulfills this need.

SUMMARY OF THE INVENTION

In view of the foregoing disadvantages inherent in the known types of crowbars now present in the prior art, the present invention provides an improved power bar device. As such, the general purpose of the present invention, which will be described subsequently in greater detail, is to provide a new and improved power bar device which has all the advantages of the prior art and none of the disadvantages.

To attain this, the present invention essentially comprises a first bar that is elongated and has substantially uniform thickness. The first elongated bar has a first end, a bend and a body portion. A wedged shaped working end projects from the bend. The wedged shaped working end has a generally rectangular slot. The body portion has a pair of generally rectangular plates fixedly attached. One plate is in a symmetrical orientation with another plate of the pair of rectangular plates. Each of the pair of plates has an ear member projecting therefrom. Each of the pair of plates has a plurality of openings. The plurality of openings of the one plate is in alignment with the pair of openings of another of the pair of rectangular plates.

Included is a second bar. The second bar is about ½ a length of the first bar. The second bar has substantially uniform thickness. The second bar has a plurality of openings therethrough. The second bar has an arced foot member that is fixedly attached to one end and spaced from the plurality of openings. The second bar is positioned between a gap of the pair of plates. Atleast one of the plurality of openings of the second bar is in alignment with one of the plurality of openings of the pair of plates.

Finally, a pin is positioned simultaneously through atleast one of the openings of the second bar and atleast one of the opens of each of the pair of plates, that are in alignment therewith, for securing the second bar between the plates of the first bar. The wedged shaped working end is capable of lever like motion when the arced foot member is positioned against a receiving surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved power bar device which has all the advantages of the prior art crowbars and none of the disadvantages.

It is another object of the present invention to provide a new and improved power bar device which may be easily and efficiently manufactured and marketed.

It is a further object of the present invention to provide a new and improved power bar device which is of a durable and reliable construction.

An even further object of the present invention is to provide a new and improved power bar device which is susceptible of a low cost of manufacture with regard to both materials and labor, and which accordingly is then susceptible of low prices of sale to the consuming public, thereby making such power bar device economically available to the buying public.

Still yet another object of the present invention is to provide a new and improved power bar device which provides in the apparatuses and methods of the prior art some of the advantages thereof, while simultaneously overcoming some of the disadvantages normally associated therewith.

Still another object of the present invention is to providing a specialized bar that allows the user to adjust the leverage area for use of the wedged shaped working end.

Lastly, it is an object of the present invention to provide a new and improved first bar. The first bar has a first end, a bend, a body portion and wedged shaped working end projecting from the bend. The body portion has a pair of generally rectangular plates fixedly attached. Each of the pair of plates having a plurality of openings. A second bar has a plurality of openings therethrough and an arced foot member that is fixedly attached to one end and spaced from the plurality of opening. The second bar is positioned between a gap of the pair of plates. A pin is positioned simultaneously through atleast one of the openings of the second bar and atleast one of the opens of each of the pair of plates, when each are in alignment therewith, for securing the second bar between the plates of the first bar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
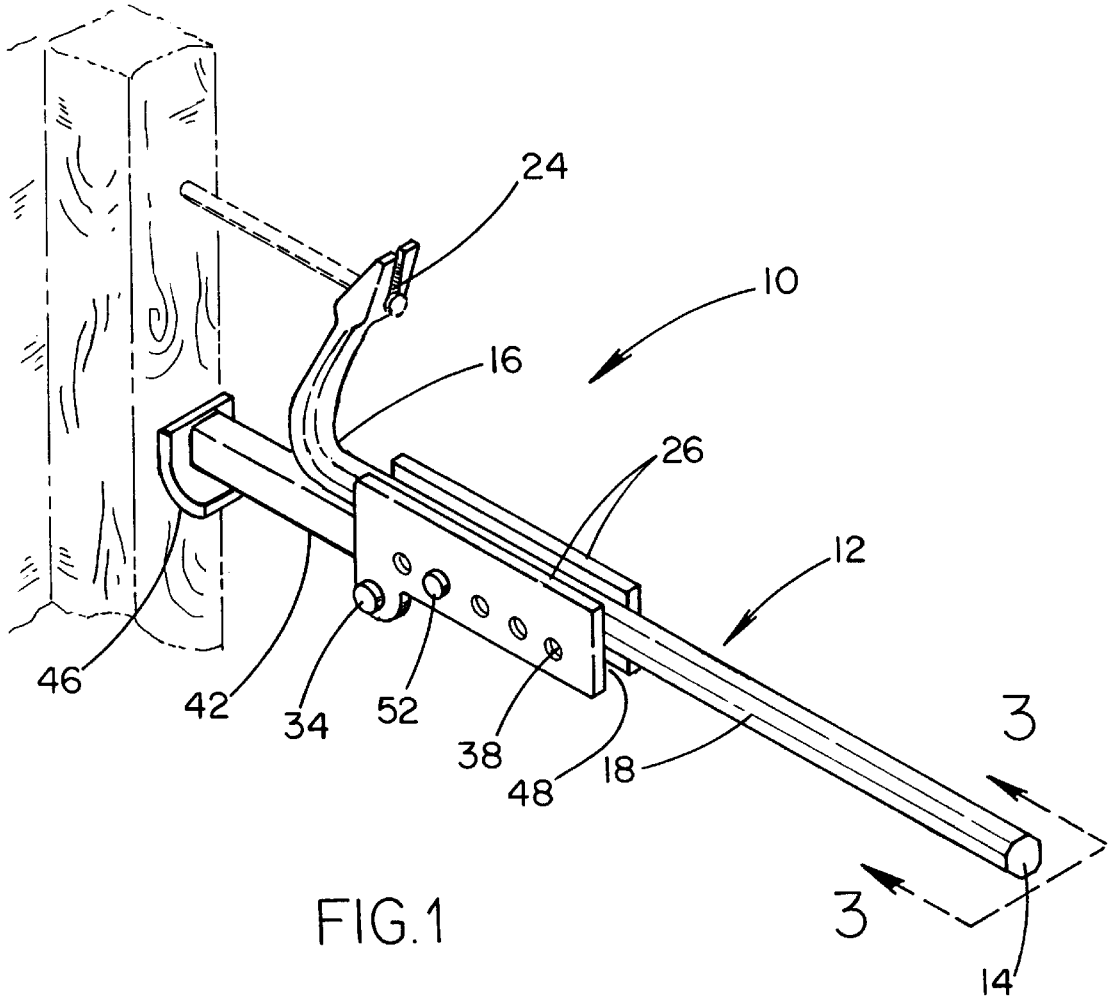
FIG. 1 is a perspective illustration of the preferred embodiment of the power bar device constructed in accordance with the principles of the present invention.

With reference now to the drawings, and in particular to FIG. 1 thereof, a new and improved power bar device embodying the principles and concepts of the present invention and generally designated by the reference numeral 10 will be described.

The present invention, the new and improved Power bar device, is comprised of a plurality of components. Such components in their broadest context include a first bar, a second bar, and a pair of plates. Such components are individually configured and correlated with respect to each other so as to attain the desired objective.

More specifically, the present invention includes a first bar 12. The first bar is elongated and has substantially uniform thickness. As shown in FIG. 1, the first elongated bar has a first end 14, a bend 16 and a body portion 18. A wedged shaped working end 22 projects from the bend. The wedged shaped working end has a generally rectangular slot 24. The slot is sized for positioning about a variety of nails or screws for their removal from a receiving structure.

Figure 3:
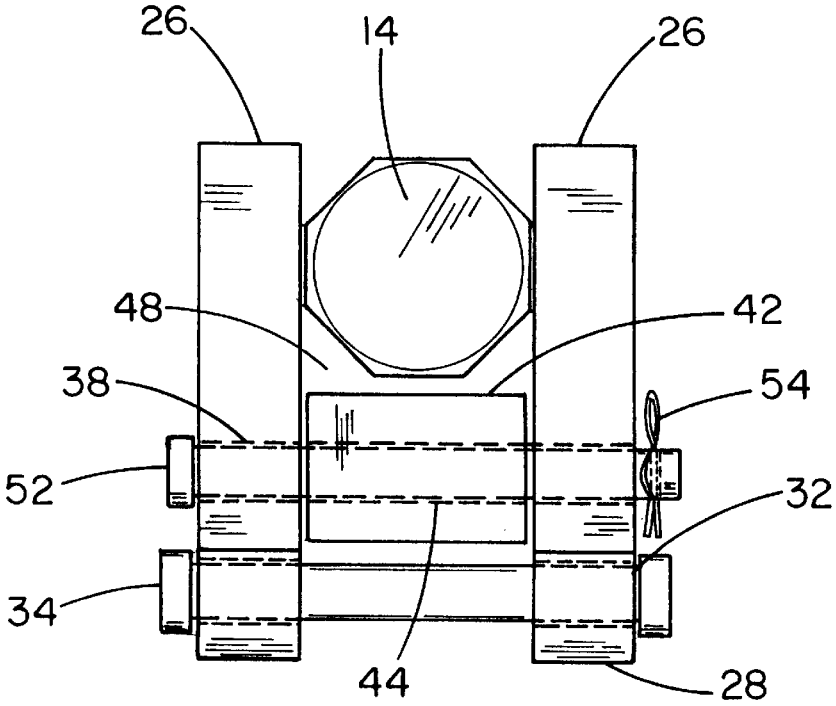
FIG. 3 is a rear view of the present invention of taken along line 3—3 of FIG. 1.

Also, the body portion has a pair of generally rectangular plates 26. As shown in FIG. 3, the pair of plates are fixedly attached to the body portion of the first bar. This is accomplished by welding each plate to the first bar. Each of the pair of plates had a width greater than the width of the first bar. The greater width allows is to extend beyond the first bar. When the pair of plates are attached, one plate is in a symmetrical orientation with another plate of the pair of rectangular plates.

Additionally, each of the pair of plates has an ear member 28. Each ear member projects from its respective plate. Each ear member has an opening 32 therethrough. The opening of one ear member is in alignment with the opening of the other ear member. Alignment of the ear members of the pair of plates allows a plate pin 34 to be positioned through the openings. Once the ear pin is in position it is welded in place. The ear pin strengthens the attachment of the pair of plates to the first bar.

As depicted in FIGS. 1 and 3, each of the pair of plates has a plurality of openings 38. The plurality of openings of the one plate is in alignment with the pair of openings of another of the pair of rectangular plates.

Figure 2:
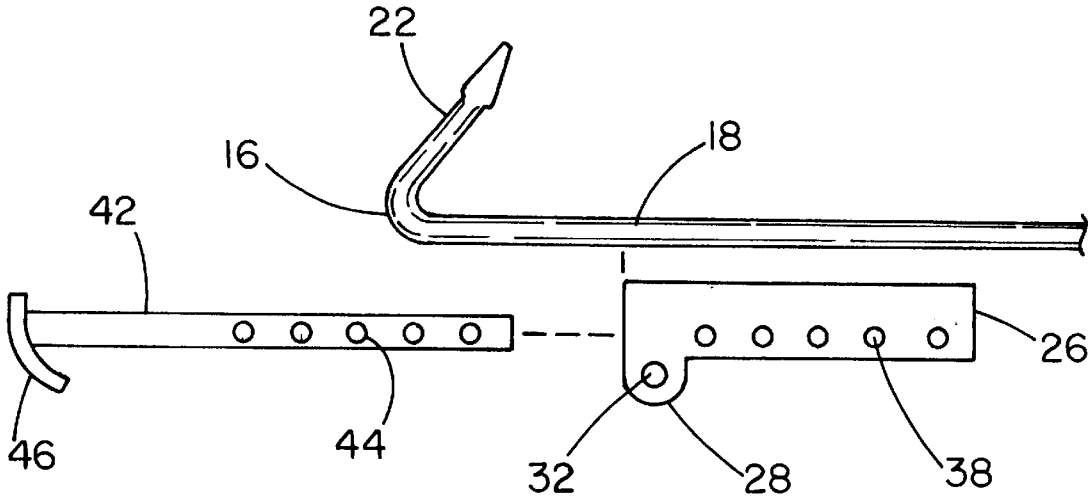
FIG. 2 is an exploded view depicting the components of the present invention of FIG. 1.

Included is a second bar 42. The second bar is about ½ a length of the first bar 12. The second bar has substantially uniform thickness. The second bar has a plurality of openings 44. The second bar has an arced foot member 46 that is fixedly attached to one end by welding. The arced foot member, as seen in FIG. 2, is spaced from the plurality of openings. The second bar is positioned between a gap 48 formed when the pair of plates extend beyond the first bar. The gap is formed after the pair of plates have been attached to the first bar.

As best illustrated in FIG. 3, atleast one of the plurality of openings 44 of the second bar is in alignment with one of the plurality of openings 38 of each of the pair of plates.

Finally, a pin 52 is positioned simultaneously through atleast one of the openings of the second bar and atleast one of the opens of each of the pair of plates, that are in alignment therewith, for securing the second bar between the plates of the first bar. The pin is removable so as to allow the second bar to be adjusted within the gap of the plates of the first bar. Once the pin is in place a cotter pin 54 is used to locked the pin in position. The wedged shaped working end is capable of lever like motion when the arced foot member is positioned against a receiving surface.

The power bar is a specialized crowbar with a fixed attachment that enables the user to extend or adjust the leverage to the prying point. The power bar is made with tow plates welded to the body portion of the crowbar, and exactly parallel to each other. Five ⅜ inch holes are drilled through the plates, 1 inch on the center. A ⅜ inch hole is drilled through the ears of the welded plates so a fixed pin can be welded within. A ¾ inch square solid bar with a welded arced foot located on the end is included. A plurality of ⅜ inch holes are drilled in the bar, with the first drilled 1, ½ inches from the end opposite the arced foot.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved power bar device comprising in combination:

a first bar being elongated and having substantially uniform thickness, the first elongated bar having a first end, a bend and a body portion therebetween, a wedged shaped working end projecting from the bend, the wedged shaped working end having a generally rectangular slot, the body portion having a pair of generally rectangular plates fixedly attached, one plate being in a symmetrical orientation with another plate of the pair of rectangular plates, each of the pair of plates having an ear member projecting therefrom, each of the pair of plates having a plurality of openings, the plurality of openings of the one plate being in alignment with the pair of openings of another of the pair of rectangular plates;

a second bar being about ½ a length of the first bar, the second bar having substantially uniform thickness, the second bar having a plurality of openings therethrough, the second bar having an arced foot member being fixedly attached to one end and spaced from the plurality of openings, the second bar being positioned between a gap of the pair of plates, at least one of the plurality of openings of the second bar being in alignment with one of the plurality of openings of the pair of plates;

a pin being positioned simultaneously through at least one of the openings of the second bar and at least one of the opens of each of the pair of plates being in alignment therewith for securing the second bar between the plates of the first bar, the wedged shaped working end being capable of lever like motion when the arced foot member being positioned against a receiving surface.

* * * * *